United States Patent [19]

Siegmund

[11] 4,053,384

[45] Oct. 11, 1977

[54] DEVICE FOR CHANGING ANODE BLOCKS, CRUST BREAKING AND CHARGING ALUMINUM FURNACES

[76] Inventor: Frederik W. Siegmund, Jekerstraat 88 P.O. Box 5018, Utrecht, Netherlands

[21] Appl. No.: 621,418

[22] Filed: Oct. 10, 1975

[51] Int. Cl.[2] ..... C22D 3/02; C22D 3/12

[52] U.S. Cl. ..... 204/244; 204/245

[58] Field of Search ..... 204/243 R, 244–247

[56] References Cited

U.S. PATENT DOCUMENTS 3,679,555 7/1972 Duclaux et al. ..... 204/243 R 3,769,195 10/1973 Weterings ..... 204/244

*Primary Examiner*—T. M. Tufariello

*Attorney, Agent, or Firm*—Snyder, Brown & Ramik

[57] ABSTRACT

Mechanism for changing anode blocks in electric furnaces for making aluminum and performing related tasks including charging the furnaces with alumina is disclosed. The mechanism includes a rotatable operator's cab carrying remotely controlled tools and alumina charging reservoirs. Both the cab and the reservoirs are translatable on the main support so as to align properly with any furnace of plural rows of furnaces.

4 Claims, 6 Drawing Figures

FIG. 4
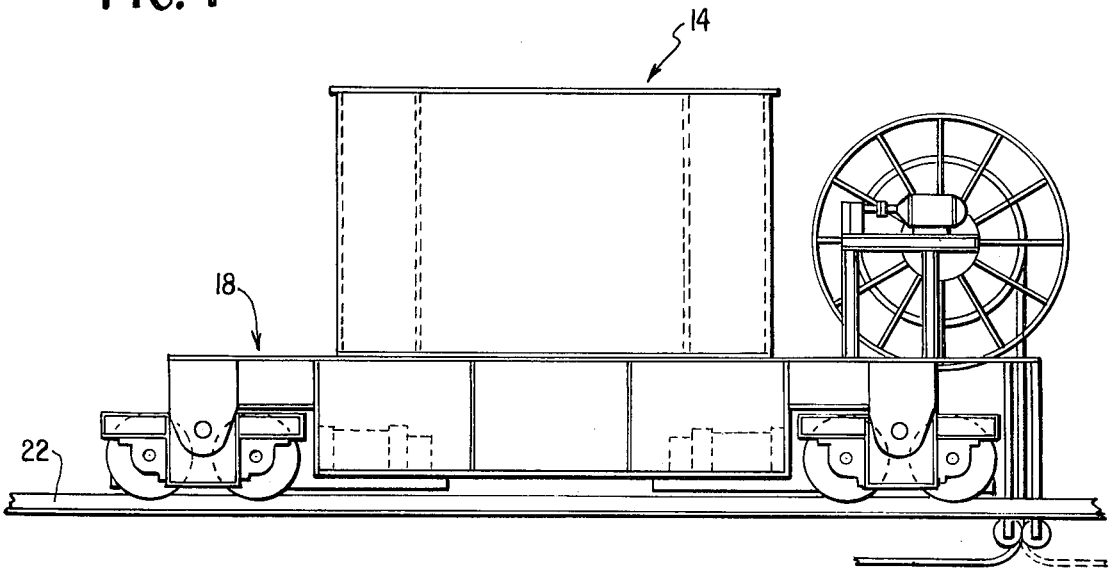
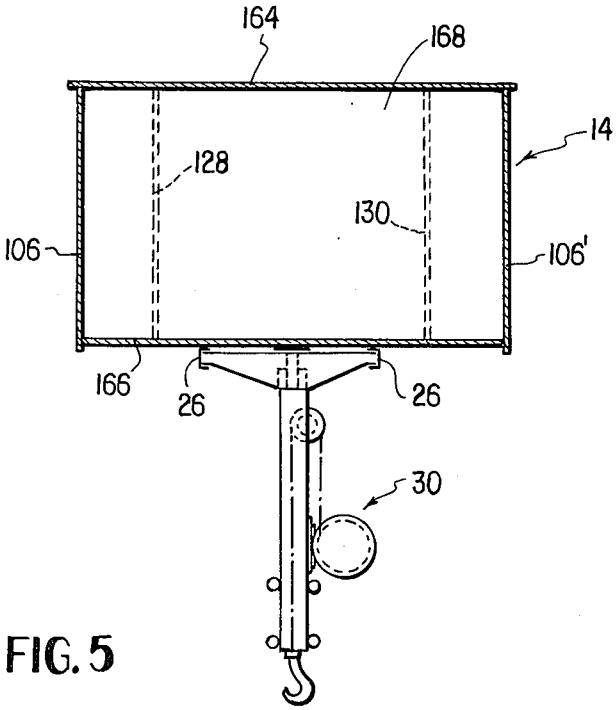
FIG. 5
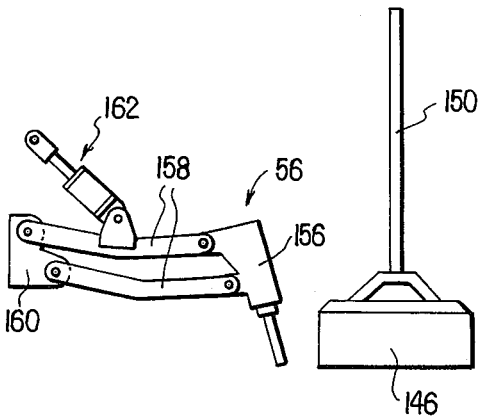
FIG. 6

DEVICE FOR CHANGING ANODE BLOCKS, CRUST BREAKING AND CHARGING ALUMINUM FURNACES

BACKGROUND OF THE INVENTION

The electrolytic process of making aluminum is well known and represents a highly important industrial process. For maximum efficiency and safety, the manipulative steps required for operation of the furnaces currently are carried out under remote control by an operator and there have been numerous automatic or semi-automatic devices developed for this purpose. Ordinarily, a production line of aluminum furnaces will constitute one or more rows of these furnaces and the automated equipment for serving the furnaces normally takes the form of some kind of movable equipment which ordinarily will include an operator's cab and from which the various tools and equipment remotely are controlled as the movable equipment travels from place to place down the line of furnaces between them to perform the requisite crust breaking, anode changing or adjusting and charging operation essential for proper operation of the furnaces. There has also been proposed various means by which a single portable or traveling device may be accommodate to service plural rows of furnaces. For example, with an overhead traveling device which is supported from rails disposed along the opposite sides of a row of furnaces, various means have been developed to translate the overhead device from one set of rails over one row of furnaces to another set of rails over another row of furnaces parallel to the first and so on. However, such arrangements have required the layout of furnaces in each row to be identical so that the traveling apparatus may similarly service each row. Among other things, the requirement for similarity between the rows of the furnaces is required in order properly to achieve the overhead charging of the furnaces with alumina. Furthermore, the devices of the prior art are fraught with one or more disadvantages inherent in attempting remotely to control the tools and equipment for servicing the furnaces within the constraint of performing there services as effectively as had previously been accomplished by manual manipulation. That is to say, particularly in the area of curst breaking, it is difficult at best to provide a remotely controlled tool which can reach into all areas of the furnace and break the crust as efficiently as previously been done by hand and this continues to present a vexing problem in the art.

BRIEF SUMMARY OF THE INVENTION

The present invention is directed to an improved overhead traveling arrangement for servicing one or more rows of furnaces and wherein there is provided improved capablity for charging the furnaces with alumina and, additionally, with improved operator cab and tool arrangement whereby the manipulative tools may be operated more effectively.

BRIEF DESCRIPTION OF THE DRAWING FIGURES

FIG. 4 is an end elevation view showing one of the trolley drive mechanism;

FIG. 5 is a transverse section taken substantially along the plane of section V—V in FIG. 1 and showing a crucible crane associated with the traveling device; and FIG. 6 is a diagrammatic view illustrating the crust breaking tool.

DETAILED DESCRIPTION OF THE INVENTION

Figure 1:
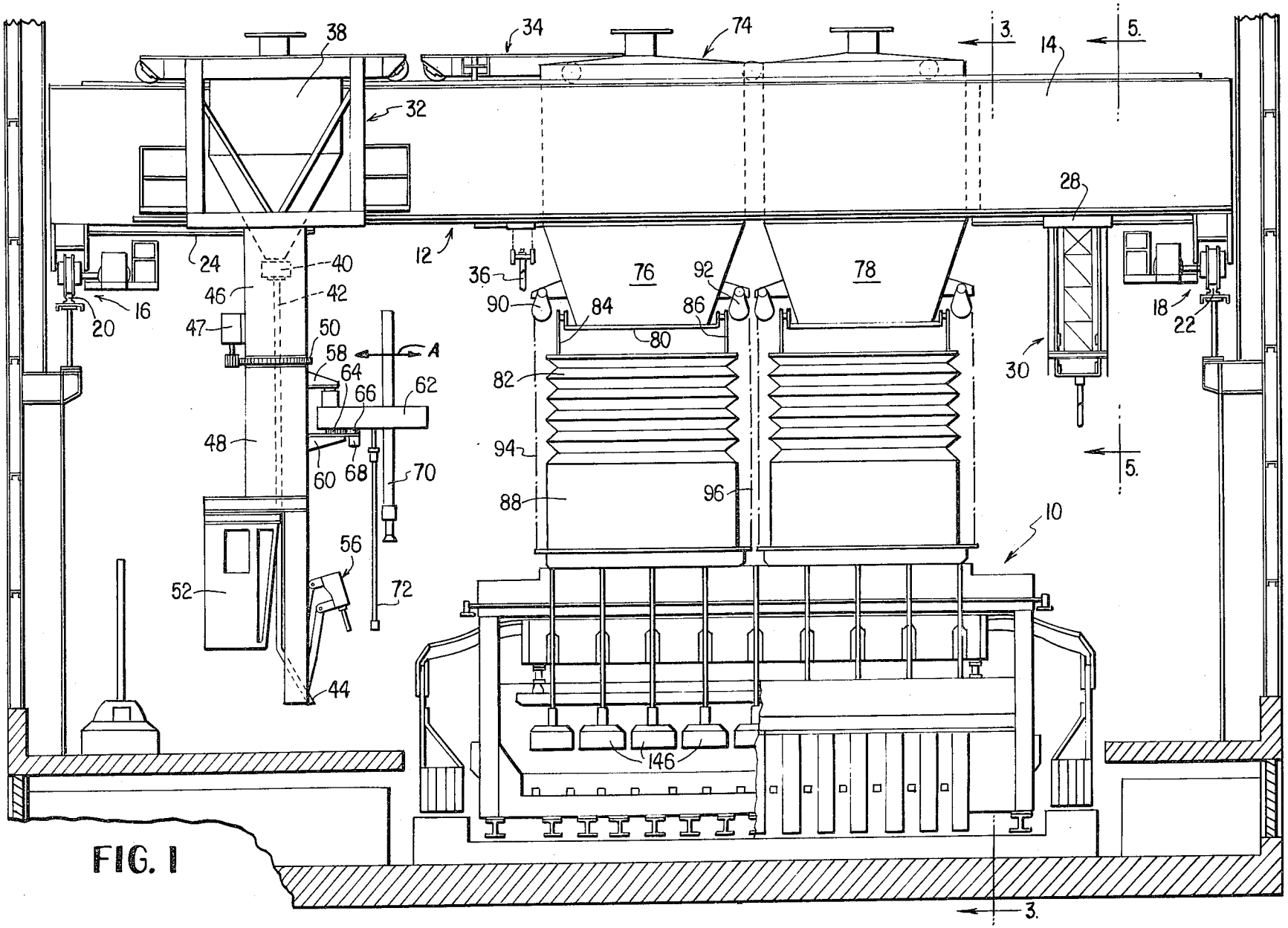
FIG. 1 is an elevational view partly broken away illustrating the overhead traveling device according to the present invention associated with one furnace in a row.

As shown in FIG. 1 associated with a row 10 of electric furnaces is an overhead traveling assembly indicated generally by the reference character 12 which comprises a bridge structure 14 provided with trolley assemblies 16 and 18 at its opposite ends which are supported on the rails 20 and 22 provided to allow the assembly 12 to travel lengthwise of the row of furnaces 10. On the underside of the bridge structure 14 and adjacent the opposite ends thereof are provided support structures 24 and 26 which support the trolley portions 28 of crucible hoisting cranes indicated generally by the reference character 30. Although it is to be seen that only one such crane 30 is illustrated in FIG. 1, it is to be understood that a further crane is associated at the opposite end of the bridge structure 14 supported from the structure 24 previously mentioned.

Supported for longitudinal movement along one side of the bridge structure 14 is the trolley structure 32 and supported along the opposite side of the bridge structure 14 for longitudinal movement therealong is a further trolley structure indicated generally by the reference character 34 and which carries a utility crane, the load-lifting hook thereof being indicated by the reference character 36. The framework of the trolley structure 32 carries an alumina hopper 38 whose lower discharge end is rotatably connected as at 40 to a down tube or spout 42 which terminates in the discharge end 44 as illustrated. The structure extends downwardly within the confines of the upper tubular section 46 and through a lower tubular section 48, the latter of which is rotatable with respect to the section 46 under the control of a drive assembly 47 mounted on section 46 and in mesh with the gear 50 which is attached to the upper end of the tubular section 48.

Attached to the lower end of the rotatable tubular section 48 is an operator's cab 52 and depending from the section 48 adjacent this cab is a support framework 54 which carries a crust breaking hammer indicated generally by the reference character 56 and which also serves to support the lower end 44 of the alumina discharge tube. The section 48 also carries a pair of bracket arms 59 and 60 which rotatably support the horizontal arm 62 about a vertical pivot axis between the free ends of the members 58 and 60. This arm 62 is driven under remote control by the operator to swing about this vertical pivot axis and for this purpose a gear 64 is attached to the arm in mesh with a rotatable gear 66 driven by a suitable motor 68, for example. The arm 62 carries a latch tool 70 and also a wrench 72, both preferably movable according to arrow A, the latch 70 being adapted to grip the upper end of an anode block supporting rod so as to adjust or to change an anode block and the tool 72 is adapted to release and tighten the anode block clamping assembly. These components are conventional and may be contructed as described in Weterings U.S. Pat. No. 3,769,195 or the Duclaux U.S. Pat. 3,627,670.

The bridge section 14 also translatably carries a hopper assembly indicated generally by the reference character 74 which, in the specific embodiment shown includes the two separate hoppers having lower discharge ends 76 and 78 projecting below the bridge structure 14 and each of which carries an extensible charging tube assembly. For example, the lower end of the hopper section 76 has associated with it discharge valve plates 80 which may be swung open to discharge alumina into the open upper end of the upper charging section 82 which is suspended, as by the straps 84 and 86 from the hopper structure to be located in spaced position therebelow. The lower section 88 of the charging tube assembly is connected to the bellows-like upper section 82 and suitable winch devices 90 and 92 have flexible members 94 and 96 issuing therefrom and which connect to the lower tube section 88 as shown to raise and lower the same into charging relationship with the furnace above which the bridge structure 14 is registered.

Figure 2:
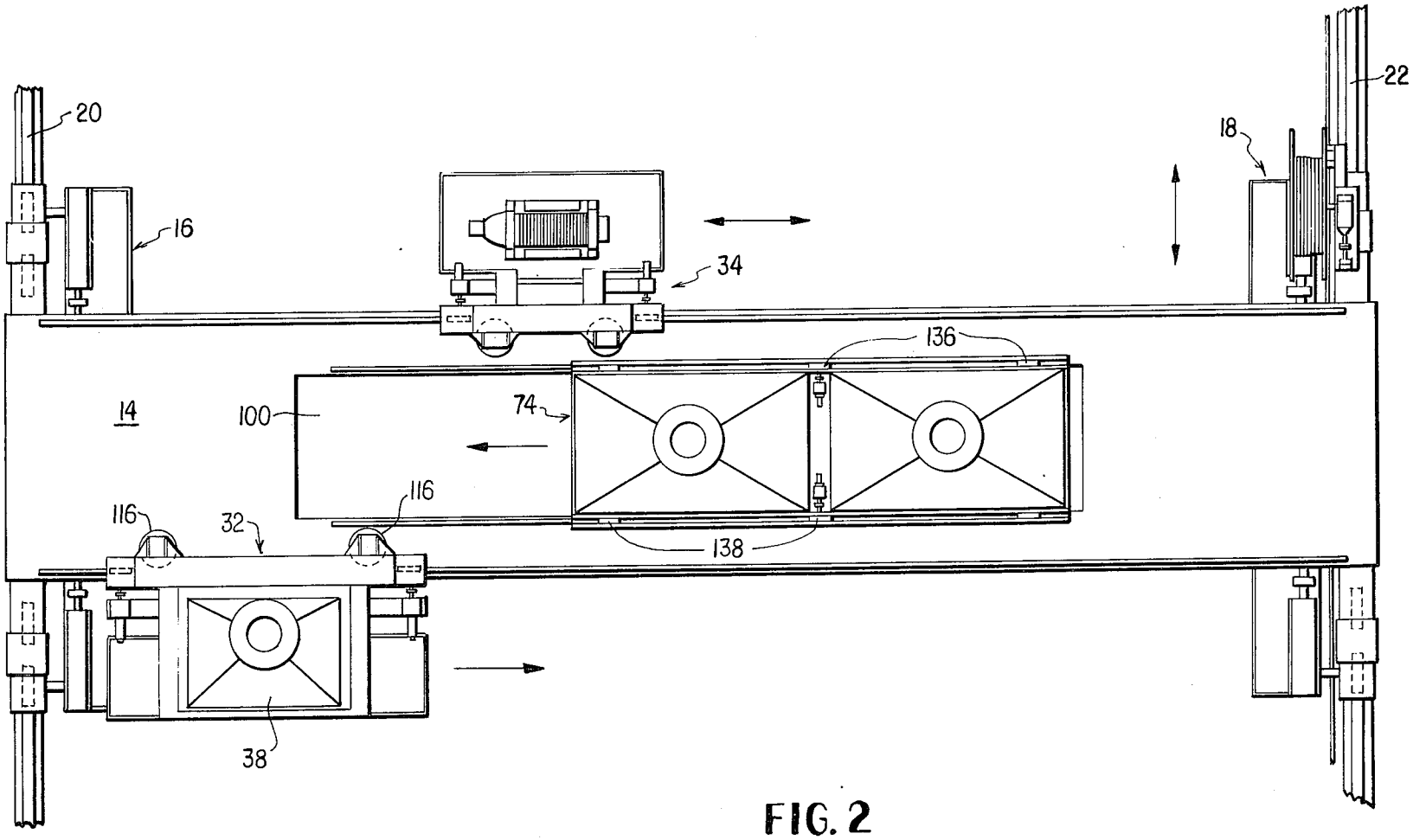
FIG. 2 is a plan view of the assembly shown in FIG. 1.
Figure 3:
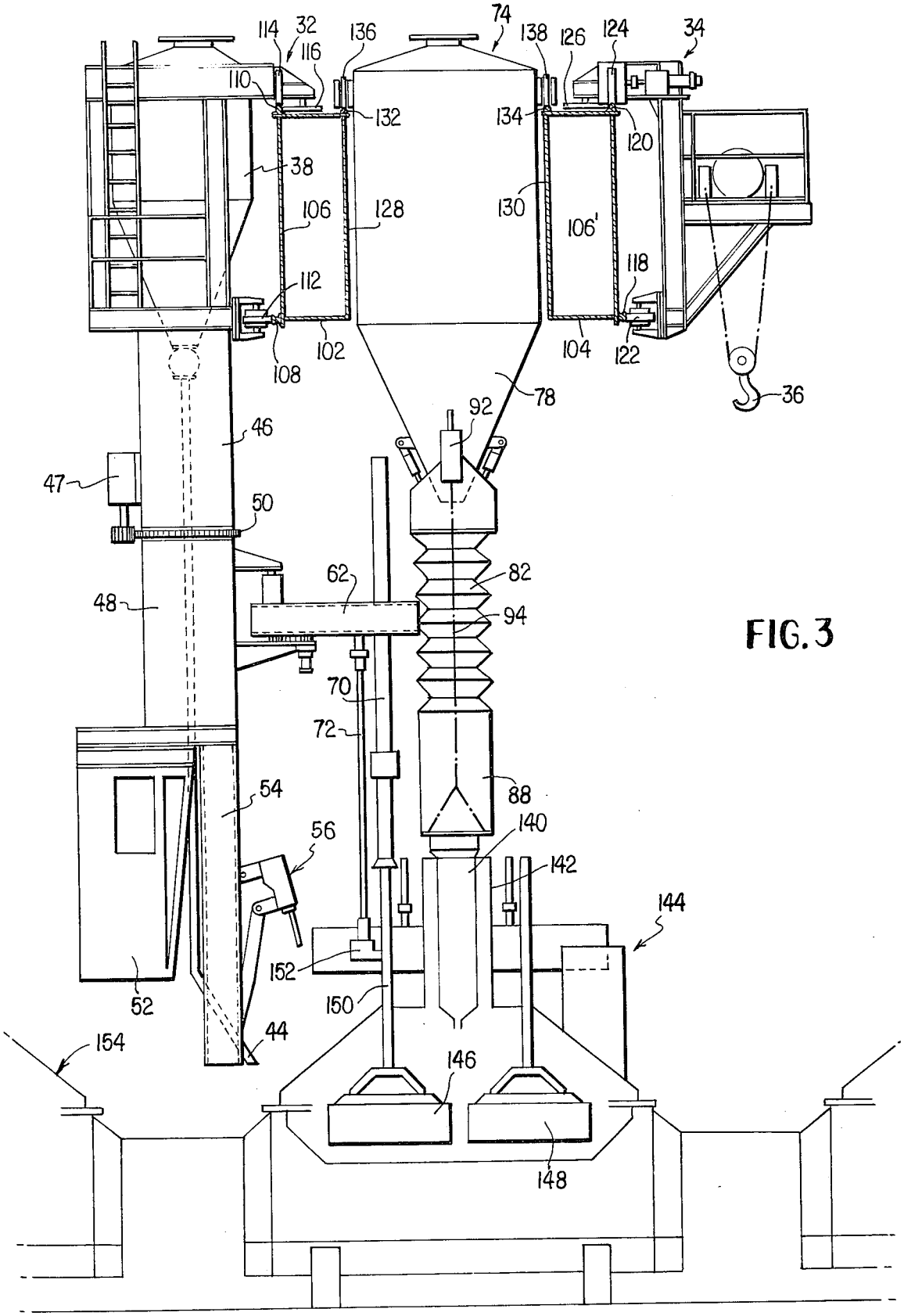
FIG. 3 is a transverse section taken substantially along the plane of section line III—III in FIG. 1 and illustrating certain details of the invention.

FIGS. 2 and 3 shown certain details of the invention. As illustrated in FIG. 2, the bridge structure 14 is provided with a longitudinally extending central opening 100 within the confines of which the charging hopper assembly 74 is movable back and forth so as properly to align and register with a particular furnace. The opening 100 is formed between the hollow, opposite side section 102 and 104 of the bridge section as is illustrated in FIG. 3. The outer side wall 106 of the section 102 carries a rail 108 adjacent its lower edge and this rail extends substantially the full length of the bridge section 14. Similarly, adjacent the upper edge of the side wall 106 is a further rail 110 likewise running substantially the full extent of the bridge section 14. These two rails 108 and 110 cooperate with the running wheels 112, 114 and 116 of the trolley assembly 32, it being understood that the wheels 114, for example, may be rotatably driven to traverse the trolley 32 back and forth along the length of the bridge section 14.

Similarly, the other section 104 carries rails 118 and 120 which cooperate with the wheels 122, 124 and 126 of the trolley 34 so that the utility crane may be traversed along the length of the bridge section 14 on the opposite side thereof from the trolley 32.

Further, adjacent the upper edge of the inner walls 128 and 130 of the sections 102 and 104 there are provided the further support rails 132 and 134 which support the wheels 136 and 138 of the traveling hooper assembly 74 whereby the main body portions of the hopper assembly 74 are supported between the sections 102 and 104 with the lower end portions 76 and 78 thereof projecting below the structure as shown.

FIGS. 4–6 show certain details of the invention. For example, in FIG. 4 the general layout and arrangement of one of the bridge supporting trolleys 18 is illustrated. The frame of the trolleys 16 and 18 are rigidly affixed to the bridge structure 14 and the trolleys themselves may take any conventional form for translating the bridge structure overhead down and along a row of furnaces 10. As mentioned previously, various arrangements have been provided for the purpose of allowing such a structure to be shifted to a further rail set associated with another row of furnaces and the assemblage according to the present invention is particularly well adapted for such utilization. In so doing, the translatable hopper assemblage 74 assumes substantial significance and importance because it allows the charging mechanism 82, 88 as is shown in FIG. 3 to be shifted longitudinally of the bridge section 14 for proper registry with the particular furnace to be charged. This can be appreciated more particularly in FIG. 3 wherein the charging tube nozzle 140 will be seen to have been aligned with the charging chimney section 142 of the furnace 144 so as to be lowered thereinto to charge alumina into the bed 144 of the furnace to flow below, around and between the anode charging blocks 146 and 148. FIG. 3 also illustrates the latching tool 70 in the process of grasping a support rod 150 of an anode block and the tool 72 in the process of engaging the screw threaded member of a clamping member 152 which serves to engage the member 150 and hold the associated anode block in place. Further, FIG. 3 illustrates another important aspect of the invention and that is the fact that a single position of the overhead bridge structure 14 permits the operator in the cab 52 not only to operate the tools 70 and 72 as well as the hammer 56 and filler spout 44 in association with the furnace 144, but also in association with the adjacent furnace 154 in the row. This is achieved simply by rotating the lower section 48 as previously described whereby to swing the tools 70, 72, 56 and 44 180° with respect to the position shown in FIG. 3 so as to provide proper operation on the adjacent furnace 154.

FIG. 6 diagrammatically illustrates the utilization of the crust breaking hammer 56, although the details of the hammer form no part of the present invention. The hammer head 156 is attached by parallelogram linkage 158 to a member 160 mounted on the supporting framework 54 and a hydraulic or pneumatic device 162 is utilized to position the head 156 and to achieve the striking action for breaking the crust around and adjacent to the anode block 146 as shown. It will be appreciated that translation of the bridge structure 14, translation of the trolley 32 along the bridge structure and rotation of the tool supporting section 48, all under remote control by the operator of the cab 52 allow the operator a wide freedom of movement for the various tools at his disposal, and in particular the hammer 56 so as to reach into a particular furnace between and around the anode blocks 56 effectively to break the crust as desired either to allow further charging of the furnace from the overhead hopper assemblage 74 or to change, adjust or otherwise operate on a particular anode block or blocks and, also, to allow the spout 44 to be positioned in a desired location for locally charging or filling in with alumina as may be desired and necessary.

FIG. 5 shows the general construction of the bridge structure 14 which, in a preferred embodiment, includes the top plate 164, the bottom plate 166 and the two side plates 106 and 106' as shown, all integrally joined to form a rigid hollow box beam section. The top and bottom plates 164 and 166 are provided with cut-outs to provide the previously mentioned opening 100 and transverse end plates 168 will be provided at either end of the opening 100 which may be rigidly attached or joined to the various plates 164, 166, 106 and 106' and to the corresponding ends of the inner wall sections 128 and 130 which cumulatively provide the previously mentioned box side sections 102 and 104 on either side of the opening 100.

What is claimed is:

1. In an aluminum making installation having at least one row of electrolysis furnaces and supporting tracks extending along the opposite sides of said row, the combination of:

a pair of trolley means supported on said tracks and movable back and forth therealong, and a bridge structure connected to and bridging between said trolley means sequentially to pass overhead the furnaces of said row, said bridge structure having first rail means disposed along one side thereof and being provided with an elongate, vertical opening in a region between said trolley means, and second rail means along the opposite sides of said opening;

a tool-carrying trolley supported on said first rail means said tool-carrying trolley including a support including upper and lower sections, an operator's cab carried by said lower section, and anode changing means carried by said lower section in full view of said operator's cab, and means for rotating said lower section relative to said upper section; and a charging hopper assembly supported on said second rail means and including at least one hopper projecting downwardly through said opening and movable back and forth lengthwise of said bridge structure within the confines of said opening so as to be registrable with a particular furnace.

2. In an installation as defined in claim 1 wherein said hopper includes a vertically extensible discharge tube depending therefrom.

3. In an installation as defined in claim 2 including a support member pivotally carried by said lower section for swinging movement relative thereto, said anode changing means being attached to said support member, and means for swinging said support member selectively to position said anode changing means.

4. In a system for tending electric furnaces for producing aluminum, which system includes a traveling overhead support adapted sequentially to pass over furnaces arranged in a row, and trolley means supported by said overhead support for movement back and forth therealong, the combination of:

a support assembly depending from said trolley means and including an upper section attached to said trolley means and a lower section pivoted about a vertical axis relation to said upper section;

an operator's cab carried by said lower section;

tool means carried by said lower section and disposed in radially displaced relation from said vertical axis;

additional tool means carried by said lower section, said lower section including a horizontally extending support arm pivoted thereto about an axis parallel to but radially displaced from said vertical axis, said additional tool means being carried by said support arm in radially displaced relation to the pivot axis for said arm, and means for swinging said arm about its pivot axis; and means for pivoting said lower section about said axis whereby selectively to position said tool means;

said overhead support including an elongate opening between its ends, and alumina-charging hopper means projecting through said opening and movably carried by said overhead support for back-and-forth movement relative thereto within the confines of said opening.

* * * * *